United States Patent [19]

Wakabayashi

[11] 4,073,237

[45] Feb. 14, 1978

[54] POWER AND FREE CONVEYOR WITH PUSHER DISENGAGING MEANS OPERABLE ON CURVED SECTIONS OF CONVEYOR TRACK

[75] Inventor: Takao Wakabayashi, Toyonaka, Japan

[73] Assignee: Nakanishi Conveyors Co. Ltd., Kanagawa, Japan

[21] Appl. No.: 699,582

[22] Filed: June 24, 1976

[30] Foreign Application Priority Data

June 24, 1975 Japan ..... 50-79028

[51] Int. Cl.[2] ..... B65G 17/42

[52] U.S. Cl. ..... 104/172 C; 104/172 S

[58] Field of Search ..... 104/172 R, 172 C, 172 S, 104/178

[56] References Cited

U.S. PATENT DOCUMENTS

| | | | |
|---|---|---|---|
| 3,411,457 | 11/1968 | Gotsch, Jr. | 104/172 S |
| 3,415,201 | 12/1968 | Czarnecki | 104/172 S |
| 3,623,538 | 11/1971 | Wakabayashi | 104/172 S |
| 3,662,688 | 5/1972 | Desilets et al. | 104/172 S |
| 3,667,399 | 6/1972 | Czarnecki | 104/172 S |
| 3,882,793 | 5/1975 | Wakabayashi | 104/172 S |

*Primary Examiner*—Lawrence J. Oresky

*Assistant Examiner*—Carl Rowold

*Attorney, Agent, or Firm*—Armstrong, Nikaido & Marmelstein

[57] ABSTRACT

A power and free conveyor includes a number of upwardly and downwardly pivotable pushers attached at a specified spacing to a drive chain on a power line, dogs mounted on a number of carriers on a free line and engageable with the pushers, and pusher raising cams mounted on the carriers and each provided at its rear end with a recess for accommodating the dog. When a preceding carrier is brought to a halt, the pusher propelling a following carrier in engagement with the dog of the carrier is raised by the cam of the preceding carrier out of engagement with the dog, permitting the dog to enter the recess of the cam simultaneously therewith, whereby the following carrier is stopped in an overlapping relation to the preceding carrier. The carrier includes at least one main free trolley on which the dog is mounted and a subfree trolley positioned to the rear of the main free trolley and connected thereto by a universal joint, the subfree trolley being provided with the pusher raising cam. At any of horizontally and vertically curved line portions, the subfree trolley is movable along the curve independently of the main free trolley.

7 Claims, 10 Drawing Figures

POWER AND FREE CONVEYOR WITH PUSHER DISENGAGING MEANS OPERABLE ON CURVED SECTIONS OF CONVEYOR TRACK

BACKGROUND OF THE INVENTION

This invention relates to a power and free conveyor, and more particularly to a pusher raising cam device for a power and free conveyor including carriers which are adapted to be stopped automatically.

As disclosed in U.S. Pat. No. 3,623,538, a power and free conveyor is already known which includes a number of upwardly and downwardly pivotable pushers spaced apart by a specified distance and attached to a drive chain on a power line, dogs mounted on a number of carriers on a free line and engageable with the pushers, and pusher raising cams mounted on the carriers and each provided at its rear end with a recess for accommodating the dog, the carries being adapted to be stopped automatically. However, since the pusher raising cam is mounted on the free trolley and projects rearward, it is impossible or very difficult for the carrier to automatically stop at line portions which are curved in horizontal and vertical planes as will be described later with reference to the drawings.

SUMMARY OF THE INVENTION

The object of this invention is to provide a power and free conveyor which has overcome the above problem. In a power and free conveyor including a number of upwardly and downwardly pivotable pushers spaced apart by a specified distance and attached to a drive chain on a power line, dogs mounted on a number of carriers on a free line and engageable with the pushers, and pusher raising cams respectively mounted on the carriers and each provided at its rear end with a recess for accommodating the dog, the conveyor of this invention is characterized by the combination comprising each of the carriers including at least one main free trolley and a subfree trolley positioned to the rear of the main free trolley and connected thereto by a universal joint, the dog mounted on the main free trolley and the pusher raising cam mounted on the subfree trolley. This construction greatly improves the serviceability of the power and free conveyor by adapting the carriers for a wide range of curvatures so that they can be stopped automatically at line portions which are curved in horizontal and vertical planes.

This invention will be described below in greater detail with reference to the accompanying drawings.

DESCRIPTION OF THE PREFERRED EMBODIMENT

Figure 1:
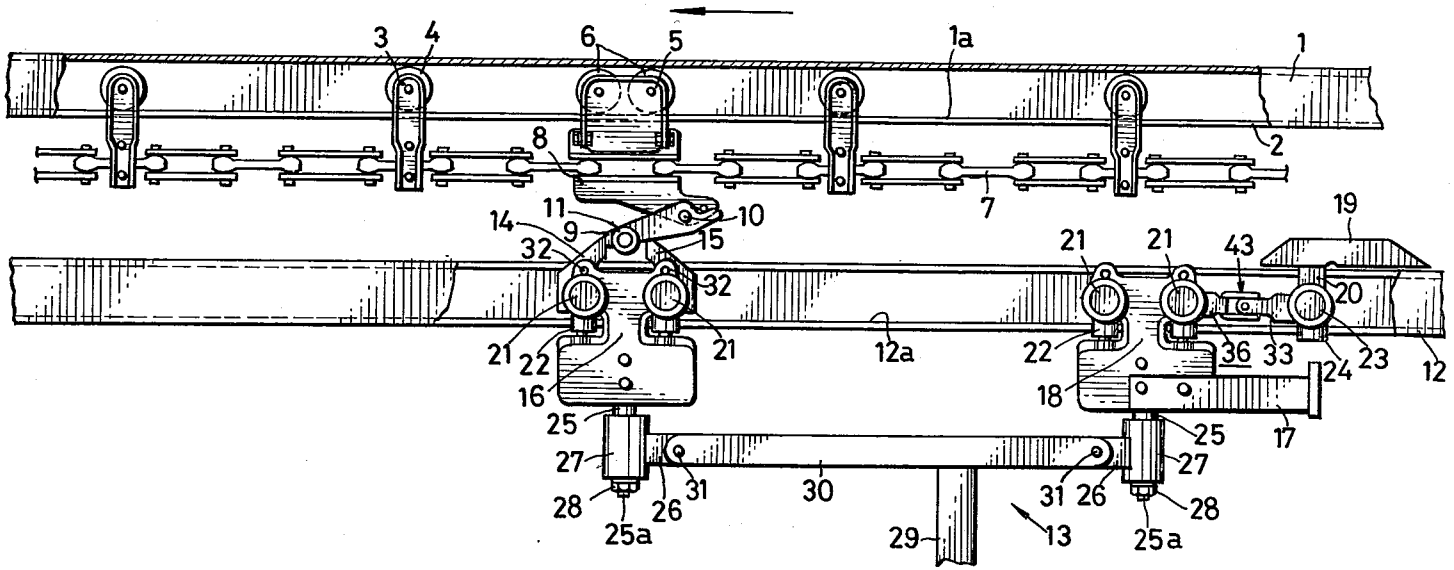
FIG. 1 is a side elevation partly broken away and showing an improved power and free conveyor of this invention.

With reference to FIGS. 1 to 4 showing an embodiment of this invention, a power rail 1 supported in a horizontal position is made of steel material having a rectangular cross section and is formed with a longitudenal slit 2 in the center of its bottom wall. Each of power trolleys 3 is provided with a pair of left and right rollers 4, while each of power trolleys 5 has pairs of left and right rollers 6 at its front and rear respectively and possesses a higher supporting capacity than the trolley 3. The trolley 5 is provided for every specified number of the trolleys 3. By means of the rollers 4 and 6, the trolleys 3 and 5 are rollably supported on the bottom 1*a* of the power rail 1 and are movable through the slit 2 in the rail 1. A drive chain 7 disposed under the rail 1 is driven always in the direction of the arrow in FIG. 1 by an electric motor and transmission means (not shown). The trolleys 3 and 5 are connected to the drive chain 7 at specified spacings. A platelike bracket 8 obliquely projecting rearwardly downward is secured to the lower end of the trolley 5. A pusher 9 obliquely projecting forwardly downward is mounted on the bracket 8 by a pin 10 in upwardly and downwardly pivotable manner. Usually the pusher 9 is held in its lowered position by the action of gravity. The pusher 9 is provided, on the opposite sides of its lower end, with a pair of inner and outer rollers 11.

A free rail 12 is disposed below the power rail 1 as spaced apart therefrom by a desired distance. The free rail 12 comprises a pair of steel channel members arranged face-to-face.

A carrier 13 includes a front main free trolley 16 having a pair of front and rear tilting dogs 14 and 15, a rear main free trolley 18 having a bumper 17 extending horizontally rearward, and a subfree trolley 20 positioned to the rear of the rear main free trolley 18 and having a pusher raising cam 19 at its upper end. Each of the free trolleys 16 and 18 carries front and rear pairs of vertical rollers 21 disposed on the opposite sides of the trolley and rollably supported on the bottom wall 12*a* of the free rail 12, and horizontal rollers 22 rollable along the inner edge of the bottom wall 12*a*. The subfree trolley 20 carries a pair of vertical rollers 23 disposed on the opposite sides of the trolley and rollably supported on the bottom wall 12*a* of the free rail 12, and a horizontal roller 24 rollable on the inner edge of the bottom wall 12*a*. Each of the main free trolleys 16 and 18 has a downwardly projecting rod 25 provided with a tube 27 rotatably fitted therearound and having a horizontal short piece 26. The lower end of the rod 25 is externally threaded as at 25*a*, and a nut 28 is screwed on the threaded portion 25*a*, whereby the tube 27 is retained on the rod 25. A link 30 having a hanger 29 and connected to the short pieces 26 by pins 31 interconnects the front and rear short pieces 26. The tilting dogs 14 and 15 are pivotably mounted on the trolley 16 by pins 32 so as to be tiltable toward each other and returnable to their upright position under gravity.

Figure 2:
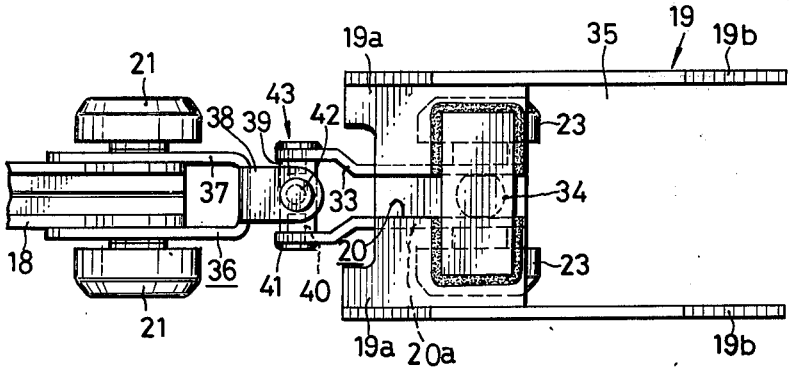
FIG. 2 is an enlarged plan view showing the principal part of the conveyor.
Figure 3:
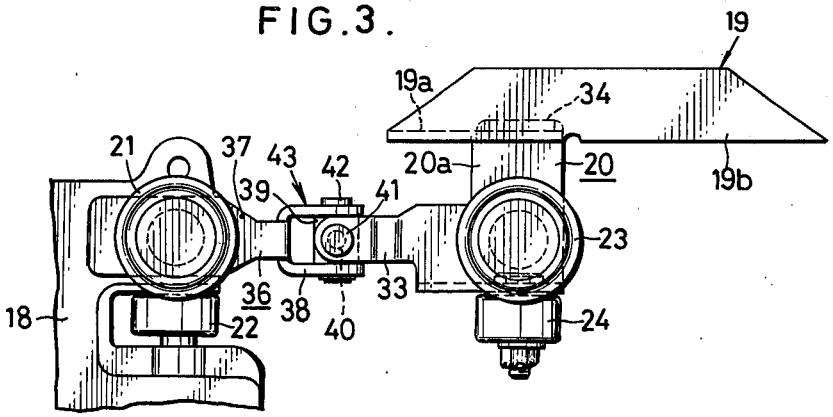
FIG. 3 is a side elevation of the principal part shown in FIG. 2.
Figure 4:
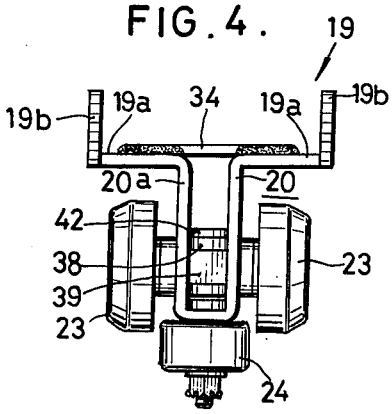
FIG. 4 is a rear view of the principal part shown in FIG. 2.

As shown in greater detail in FIGS. 2 to 4, the subfree trolley 20 comprises a U-shaped trolley main body 20*a* made of a piece of metal plate, horizontal wings 19*a* extending from the upper end of the main body horizontally outward away from each other, trapezoidal cam portions 19*b* extending vertically from the outer ends of the wings 19*a* and projecting rearward; and a pair of vertical extensions 33 extending forward from the main body 20*a*. A rectangular reinforcing plate 34 extends over the wings 19*a* and is secured to the top surfaces of the wings 19*a* by welding. To the rear of the wings 19*a*, the pair of cam portions 19*b* defines a dog accommodating recess 35 therebetween. The rear main free trolley 18 is provided with a joint member 36 comprising a vertical front bifurcated portion 37 and a horizontal rear bifurcated portion 38. The vertical bifurcated portion 37 is secured to the rear end upper portion of the main free trolley 18. Provided between the front ends of the extensions 33 of the subfree trolley 20 is a connector 39 formed in its opposite ends with bores 40, in which headed pins 41 passed through the extensions 33 are inserted to hold the extensions 33 to the connector 33 vertically pivotably. The heads of the pins 41 are welded to the outer surfaces of the extensions 33. A vertical pin 42 extends through the horizontal bifurcated portion 38 and through the connector 39 received in the portion 38, holding the bifurcated portion 38 to the connector 39 horizontally pivotably. These parts constitutes a universal joint 43. Thus the universal joint 43 comprises the joint member 36 including the vertical bifurcated portion 37 secured to and extending rearward from the rear end of the main free trolley 18 and the horizontal bifurcated portion 38 integral with and extending further rearward from the vertical bifurcated portion 37, the pair of vertical extensions 33 extending forward from the subfree trolley 20, and the connector 39 provided between the rear end of the horizontal bifurcated portion 38 and the pair of vertical extensions 33.

As shown in FIG. 1, the carrier 13 is driven in the direction of the arrow by the pusher 9 along with the drive chain 7 by virtue of the engagement, from behind, of the pusher 9 with the front tilting dog 14 on the front main free trolley 16. Although unillustrated, a number of carriers are similarly driven at a specified spacing, following the above-mentioned carrier. The spacing is determined by the spacing of the pushers 9 suspended from the drive chain 7.

The carriers travelling in succession are brought to a halt in the following manner. In front of a leading carrier 13, a stopper (not shown) corresponding to the cam 19 is projected upward from the free rail 12 by an unillustrated hydraulic cylinder. The rollers 11 on the opposite sides of the pusher 9 propelling the leading carrier 13 roll up the upper surface of the stopper, raising the pusher 9 out of engagement with the front tilting dog 14, whereupon the carrier 13 is brought to a halt. When the leading or first carrier 13 has been stopped, a second carrier and the following carriers are still travelling with the drive chain 7. Consequently the front tilting dog 14 on the main free trolley 16 of the second carrier 13 enters the recess 35 of the cam 19 on the subfree trolley 20 of the first carrier 13. At this time, the pusher 9 in engagement with the front tilting dog 14 is raised and thereby disengaged from the dog 14, because the rollers 11 on the opposite sides thereof roll up the cam portions 19*b*. As a result, the second carrier 13 comes to a stop in an overlapping relation to the first carrier 13. The pusher 9 still continues to advance, rising again at the location of the stopper and passes over the main free trolley 16 of the first carrier 13. Although the drive chain 7 carrying the pushers 9 continues to travel, a third carrier and the following carriers come to a halt in succession, each in an overlapping relation to the preceding carrier.

To bring the stopped carriers into travel again, the stopper is retracted from above the free rail 12. A pusher 9 advancing from behind the first carrier 13 will then forwardly push down the rear tilting dog 15 on the main free trolley 16 and come into engagement with the front tilting dog 14, with the result that the first carrier 13 starts to advance along with the drive chain 7. The rear tilting dog 15 returns to its original position under gravity after the pusher 9 has passed thereover. With the travel of the first carrier 13, the subfree trolley 20 thereof along with its cam 19 leaves the main free trolley 16 of the stopped second carrier 13. Consequently a following pusher 9 comes into engagement with the front tilting dog 14 on the main free trolley 16 of the second carrier 13, advancing the second carrier in the same manner as above. Similarly the stopped carriers are brought into travel in succession and advanced as spaced apart by a distance corresponding to the spacing of the pushers 9.

Now curved portions of the conveyor line will pose problems.

Figure 5:
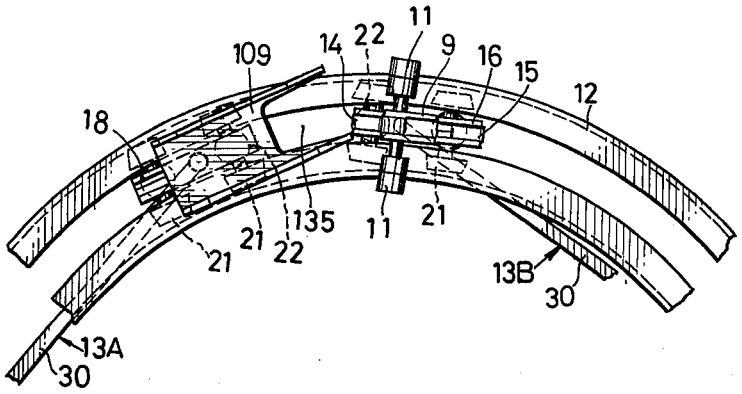
FIG. 5 is a plan view showing a conventional conveyor at a line portion curved in a horizontal plane.
Figure 6:
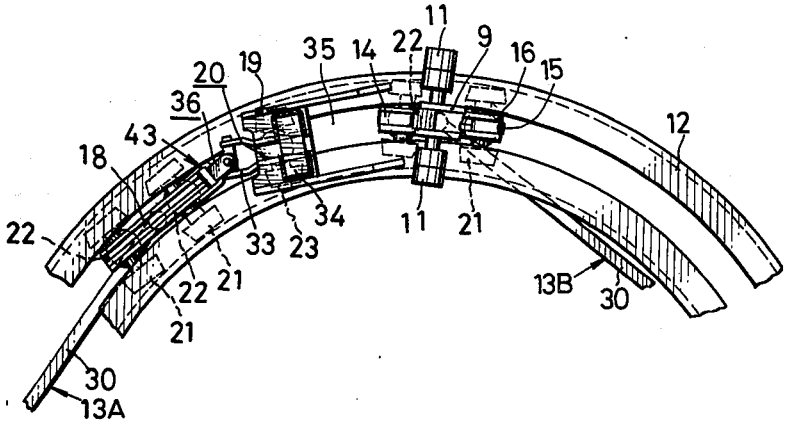
FIG. 6 is a plan view showing the embodiment of this invention at the same portion.

For comparison, FIGS. 5 and 6 show a conventional conveyor and the embodiment of this invention at a line portion curved in a horizontal plane. The conventional conveyor shown in FIG. 5 includes a cam 109 which is mounted directly on the upper end of the rear free trolley 18. Accordingly the cam 109 is directed invariably in the same direction as the free trolley 18. The direction of the free trolley 18 is determined by the direction of the two pairs of rollers 21 carried by the trolley 18. Since the cam 109 projects rearward from the free trolley 18, the rear portion of the cam 109 is turned aside from the curve of the free rail 12, namely deviated outside from the axis of the curved portion by a certain angle, with the result that the front tilting dog 14 of a following carrier 13B will contact the rear end of the cam 109 of a preceding carrier 13A without entering the recess 135 thereof, possibly causing an accident. Usually the shape of the cam 109 is suitably modified as desired in order to avoid this problem, but it is impossible to adapt the cam 109 for a markedly curved portion by such modification.

According to this invention, however, the main free trolley 18 and the subfree trolley 20 are connected together by the universal joint 43, and the subfree trolley 20 has only one pair of side rollers 23 instead of the front and rear pair of rollers, so that the rear portion of the cam 19 is substantially in alignment with the axis of the curved portion of the free rail 12 as seen in FIG. 6. This assures that the front tilting dog 14 of a following carrier 13B will enter the recess 35 of the cam 19 of a preceding carrier 13A. As a result, the carriers can be automatically brought to a stop one after another in an overlapping relation to each other as already described, even at line portions which are curved in a horizontal plane.

Figure 7:
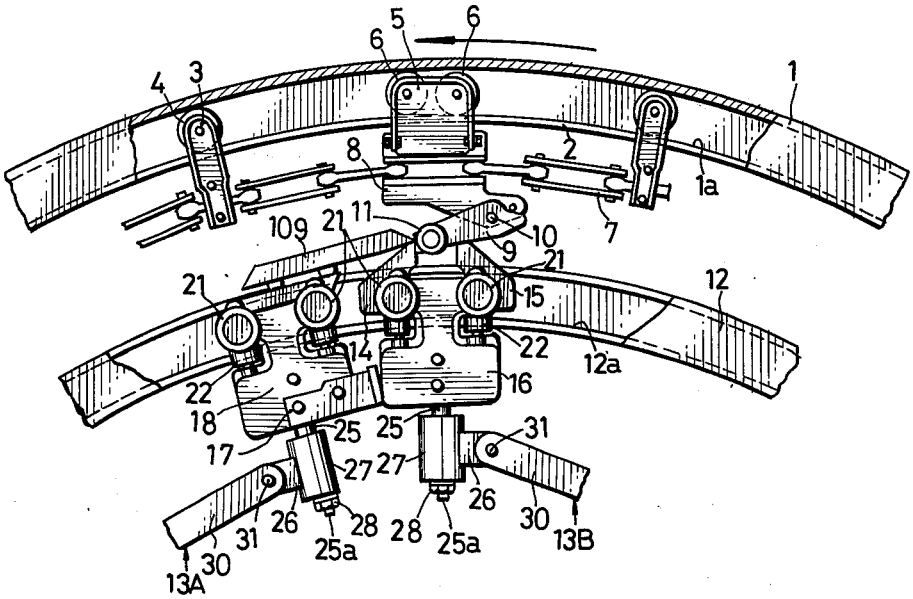
FIGS. 7 and 8 are side elevations of the conventional conveyor at curved line portions bulging out upwardly and downwardly respectively in a vertical plane.

Further for comparison, FIGS. 7 to 10 show the conventional conveyor and the embodiment of this invention at line portions curved in a vertical plane. FIG. 7 shows the conventional conveyor at an upwardly protruding curved portion. As will be apparent from the drawing, the cam 109 of a preceding carrier 13A projects rearward from the free trolley 18, and the rear portion of the cam is therefore deviated upside from the axis of the curved portion. Consequently while a pusher 9 propelling a following carrier 13B is advancing, portions of the rollers 11 on that pusher 9 above their center will strike the rear lower end of the cam 109 of the preceding carrier, with the result that the pusher 9 fails to rise along the cam 109 and causes an accident.

Figure 8:
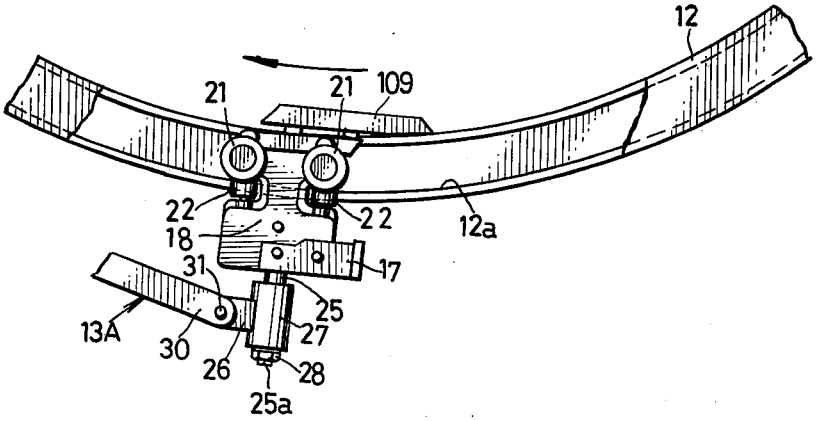

Further at a downwardly protruding curved portion of the conventional conveyor shown in FIG. 8, the rear end of the cam 109 of the carrier 13A will be deviated downside from the axis of the curved portion and therefore contacts the upper surface of the free rail 12. Accordingly the cam 109 will be damaged.

Figure 9:
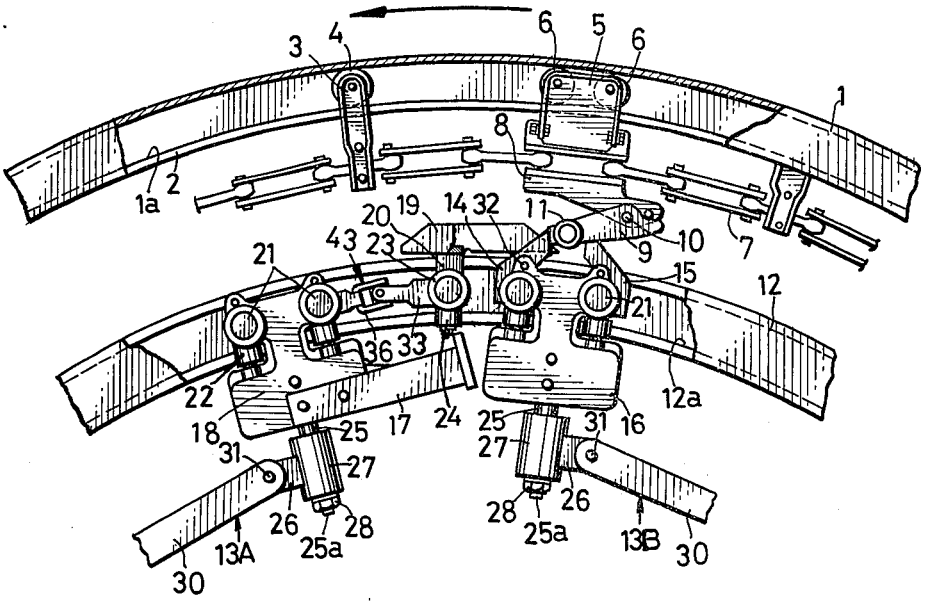
FIGS. 9 and 10 are side elevations of the embodiment of this invention at the same portions.
Figure 10:
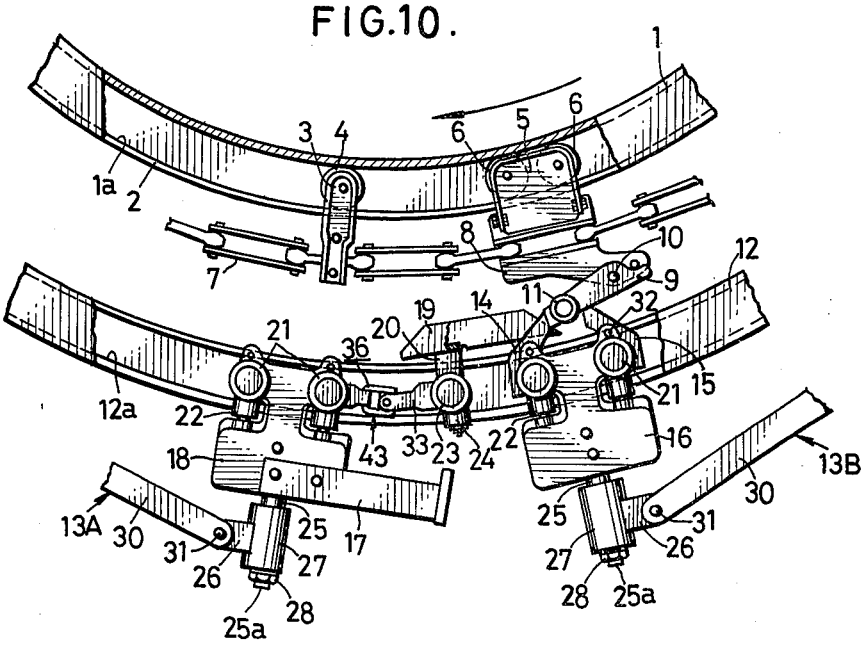

FIGS. 9 and 10 show the embodiment of this invention at curved portions corresponding to those shown in FIGS. 7 and 8 respectively. As in the horizontally curved portion, the rear portion of the cam 19 of a preceding carrier 13A is substantially in alignment with the axis of the vertically curved portions. This assures that the front tilting dog 14 of a following carrier 13B will enter the recess 35 of the cam 19 on the preceding carrier 13A. Thus at line portions curved in a vertical plane, the carriers can be automatically brought to a halt one after another in an overlapping relation to each other.

Although the carrier in the foregoing embodiment includes two main free trolleys, the number of the main free trolley is variable. For example, the carrier may include one main free trolley, in which case a main free trolley equipped with a tilting dog is connected by a universal joint to a subfree trolley having a cam.

This invention may be embodied differently without departing from the spirit and basic features of the invention. Accordingly the embodiment herein disclosed is given for illustrative purposes only and is not in any way limitative. It is to be understood that the scope of this invention is defined by the appended claims rather than by the specification and that various alterations and modifications within the definition and scope of the claims are included in the claims.

What is claimed is:

1. In a power and free conveyor including a plurality of upwardly and downwardly pivotable pushers spaced apart by a predetermined distance and attached to a drive chain on a power line, a dog mounted on each of a plurality of carriers on a free line and engageable with the pusher, and pusher raising cams respectively mounted on the carriers and each provided at its rear end with a recess for receiving the dog, the improvement wherein each of the carriers includes at least one main free trolly, a subfree trolley positioned to the rear of the main free trolley, the main free trolley having at least two pairs of vertical rollers for supporting the main free trolley on the free line and the subfree trolley having only one pair of vertical rollers for supporting the subfree trolley on the free line, and a universal joint coupling the subfree trolley to the main free trolley, wherein the dog is mounted on the main free trolley and the pusher raising cam is mounted on the subfree trolley and wherein when said subfree trolley is located on a curve on the free line the pusher raising cam is aligned substantially parallel to the tangent to the line.

2. A conveyor as defined in claim 1 wherein the carrier includes a front main free trolley and a rear main free trolley connected together by a link, and the dog is mounted on the front main free trolley.

3. A conveyor as defined in claim 1 wherein the universal joint comprises a joint member including a vertical bifurcated portion secured to and extending rearward from the rear end of the main free trolley and a horizontal bifurcated portion integral with and extending further rearward from the vertical bifurcated portion, a pair of vertical extensions extending forward from the subfree trolley, and a connector provided between the rear end of the horizontal bifurcated portion and the pair of vertical extensions.

4. A conveyor as defined in claim 1 wherein the subfree trolley comprises a U-shaped trolley main body horizontal wings extending from the upper end of the main body horizontally outward away from each other, cam portions extending vertically from the outer ends of the wings and projecting rearward, and a pair of vertical extensions extending forward from the main body, the pair of cam portions defining a dog accommodating recess therebetween to the rear of the wings.

5. A conveyor as defined in claim 4 wherein a reinforcing plate extends over and is secured to the wings.

6. A conveyor as defined in claim 1 wherein the subfree trolley further includes a horizontal roller.

7. A conveyor as defined in claim 1 wherein the cam is trapezoidal in the vertical plane.

* * * * *